US005129211A

United States Patent [19]

Anderson

[11] Patent Number: 5,129,211

[45] Date of Patent: Jul. 14, 1992

[54] METHOD AND AN ARRANGEMENT FOR THE MANUFACTURE OF A PACK CONSISTING OF A BANDEROLE-LIKE PACK SLEEVE

[76] Inventor: Claes-Göran Andersson, Snäckeskärsgatan 16, S-421 57, Västra Frölunda, Sweden

[21] Appl. No.: 670,358

[22] PCT Filed: Dec. 18, 1987

[86] PCT No.: PCT/SE87/00615

§ 371 Date: Apr. 6, 1989

§ 102(e) Date: Apr. 6, 1989

[87] PCT Pub. No.: WO88/05016

PCT Pub. Date: Jul. 14, 1988

Related U.S. Application Data

[63] Continuation of Ser. No. 346,895, Apr. 6, 1989, abandoned.

[30] Foreign Application Priority Data

Jan. 2, 1987 [SE] Sweden ..... 8700071

[51] Int. Cl.[5] ..... B65B 11/08

[52] U.S. Cl. ..... 53/399; 53/228; 53/466; 53/543; 206/391

[58] Field of Search ..... 53/158, 171, 176, 221, 53/228, 399, 436, 438, 443, 448, 449, 461, 463, 466, 528, 529, 586; 206/443, 446, 391, 393, 394, 386, 397, 430, 432, 497, 526, 499

[56] References Cited

U.S. PATENT DOCUMENTS

| | | | |
|---|---|---|---|
| 1,014,380 | 1/1912 | Davis | 206/394 X |
| 3,202,276 | 8/1965 | Burt et al. | 206/391 |
| 3,224,640 | 12/1965 | Schneider et al. | 222/107 |
| 3,279,146 | 10/1966 | Ficht | 53/586 |
| 3,347,365 | 10/1967 | Funkhouser | 206/432 X |
| 3,385,429 | 5/1968 | Becker et al. | 206/432 X |
| 3,419,138 | 12/1968 | Halsberghe | 206/413 |
| 3,460,671 | 8/1969 | Harm | 206/391 |
| 3,590,549 | 7/1971 | Zelnick | 53/466 X |
| 3,638,790 | 2/1972 | Schmid et al. | 206/446 |
| 3,643,396 | 2/1972 | Togashi et al. | 53/438 |
| 3,761,289 | 9/1973 | Wolf | 206/499 X |
| 3,966,045 | 6/1976 | Perdue | 206/443 |
| 3,994,116 | 11/1976 | McCormack | 53/228 X |
| 4,201,031 | 5/1980 | Wiles | 53/455 |
| 4,385,691 | 5/1983 | Klygis | 206/150 |
| 4,499,706 | 2/1985 | Scheller | 53/399 |
| 4,535,587 | 8/1985 | Rias | 53/436 |
| 4,595,093 | 6/1986 | Eckstein | 206/391 X |
| 4,628,668 | 12/1986 | Wildmoser | 53/399 |
| 4,679,379 | 7/1987 | Cassoli | 53/438 |
| 4,765,474 | 8/1988 | James | 206/391 |

FOREIGN PATENT DOCUMENTS

| | | |
|---|---|---|
| 0174674 | 3/1986 | European Pat. Off. . |
| WO83/03808 | 11/1983 | PCT Int'l Appl. . |
| 412360 | 3/1980 | Sweden . |
| 424849 | 8/1982 | Sweden . |

*Primary Examiner*—Bryon P. Gehman
*Attorney, Agent, or Firm*—Dvorak and Traub

[57] ABSTRACT

A number of pack units (3; 3[1]), such as rolls of soft tissue paper or packs of nappies, etc., which are enclosed by a banderole-like pack sleeve (2). The invention enables a pack to be produced which is well suited to efficient manufacture and which is also suitable for simple and safe handling, both in the production channel and in the consumer channel. In the area outside pairs of pack units (3; 3[1]) situated adjacent to one another, said pack sleeve (2) is attached to a holding device (4) running in an essentially straight path between the pack units (3; 3[1]). The invention also relates to a method for the manufacture of pack of this kind, and to an arrangement for the production of a pack of this kind.

1 Claim, 8 Drawing Sheets

FIG. 1
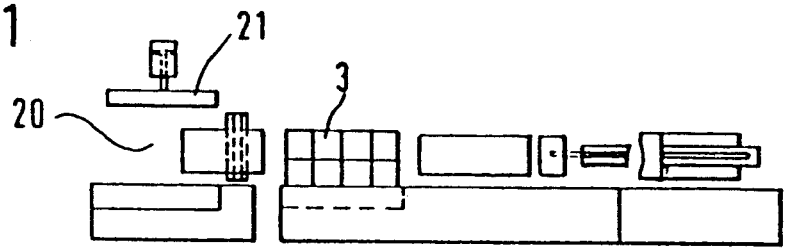
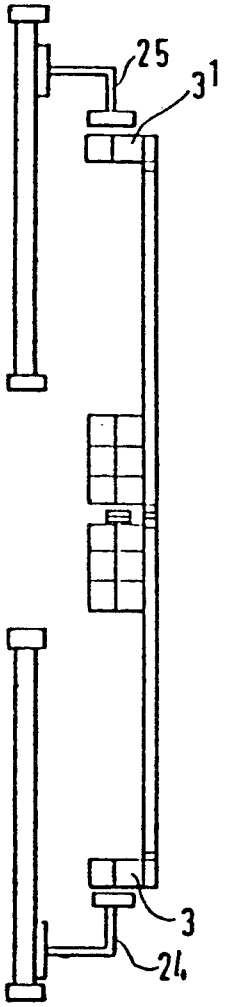
FIG. 3
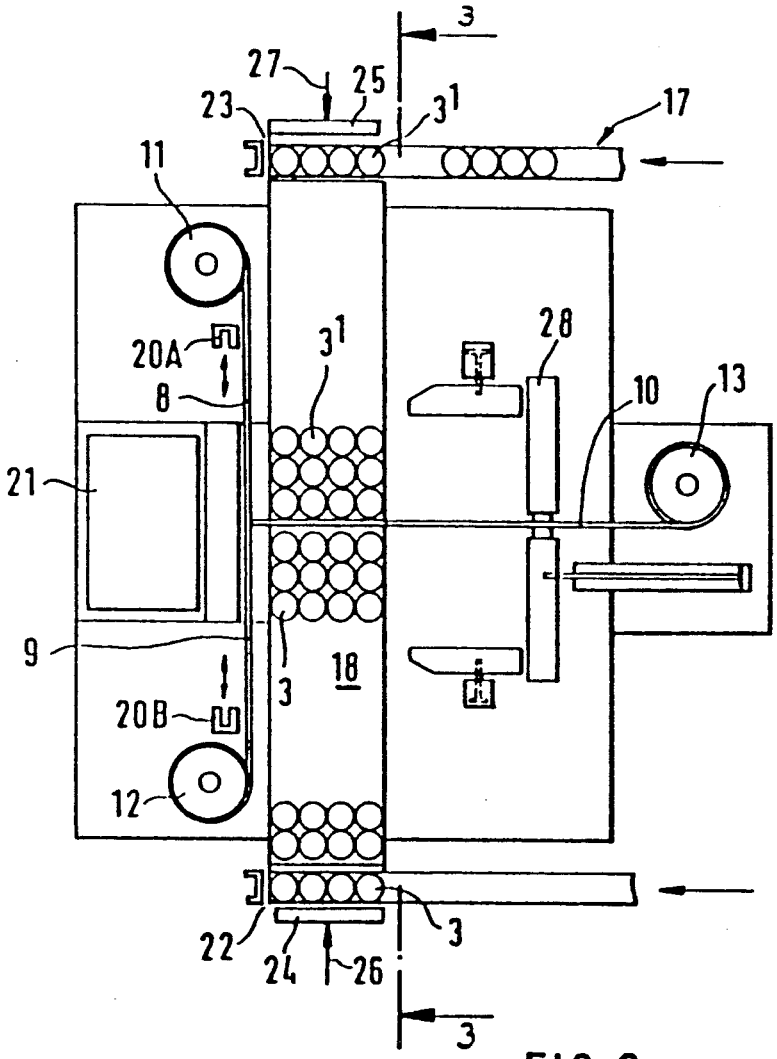
FIG. 2

FIG. 13
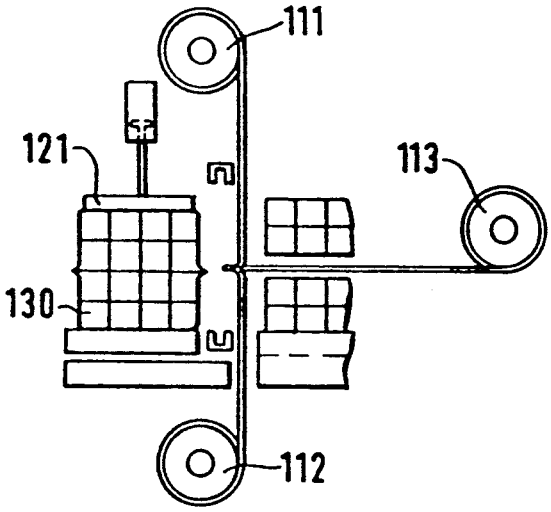
FIG. 14
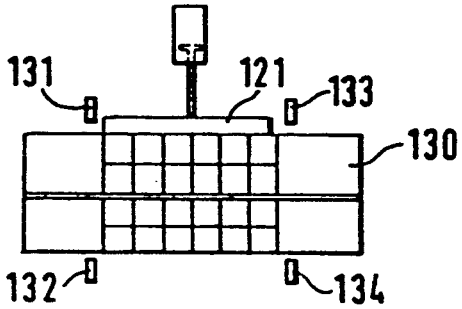
FIG. 15
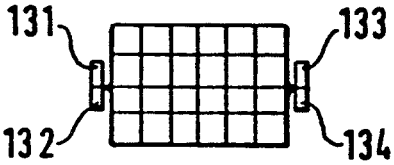
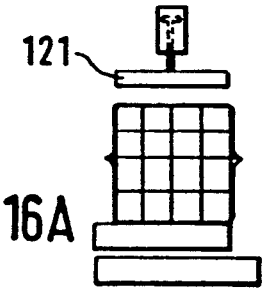
FIG.16A
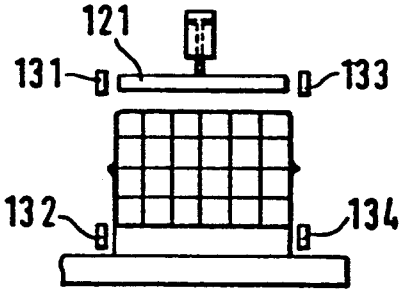
FIG. 16

METHOD AND AN ARRANGEMENT FOR THE MANUFACTURE OF A PACK CONSISTING OF A BANDEROLE-LIKE PACK SLEEVE

This application is a continuation of application Ser. No. 346,895, filed Apr. 6, 1989, now abandoned.

The present invention relates to a pack containing a number of pack units, such as rolls of soft tissue paper or packs of nappies, etc., which are enclosed by a banderole-like pack sleeve.

Previously disclosed packs for goods, such as rolls of soft tissue paper, nappies and napkins, etc., are very costly for both shops and consumers and also involve inefficient and expensive handling, such as the manual production of so-called retail packs for assembly into sales packs, for example in the form of bags made of a plastics material and loosely stacked and tied units, the loading of packs onto trolleys, the transport of same to the pint of display, the breaking open of the packs, price-marking, stacking, and the return transport of the empty packaging materials.

The principal object of the present invention is thus in the first instance to make available a pack which, amongst other things, solves the problems referred to above and permits the automated production of said pack, without the risk of the pack breaking apart during handling of same with the associated danger of the pack units in question unintentionally becoming separated from the pack.

Said object is achieved by means of a pack in accordance with the present invention, which is characterized essentially in that, in the area outside pairs of pack units situated adjacent to one another, said pack sleeve is attached to a holding device running in an essentially straight path between the pack units.

A further object of the invention is to discover a method which solves the problem of manufacturing packs of the kind described in a simple and efficient manner.

Said further object is achieved by means of a method in accordance with the present invention, which is characterized essentially in that three pieces of packaging material are so arranged as to accept pack units to either side of a centrally situated piece of packaging material acting as a holding device, and as to be finally attached to one another at a certain distance from one another on opposing sides of the formed pack, so that the two outermost pieces of packaging material enclose all the pack unit and said centrally situated piece of packaging material in the manner of a banderole.

A final object of the present invention is to make available an arrangement which can be utilized in conjunction with the production of a pack in accordance with the present invention.

Said final object is achieved by means of a an arrangement in accordance with the present invention which is characterized essentially in that, to either side of a forming station intended to accommodate pack units, feed devices for the pieces of packaging material are situated in such a way that they are able, in conjunction with the movement of a group of formed pack units, to feed the pieces of material towards one another and in the direction of a jointing device with one of the pieces of material surrounded by pack units, and in that preferably compression and fixing devices for said group of pack units are provided.

The invention is described below as a number of preferred illustrative embodiments, in conjunction with which reference is made to the drawings, in which FIGS. 1–6A illustrate different positions for an arrangement arranged for the production of packs which include a sleeve running in a vertical sense;

FIGS. 7–16A illustrate different positions for an arrangement arranged for the production of packs which include a sleeve running in a horizontal sense;

Figure 17:
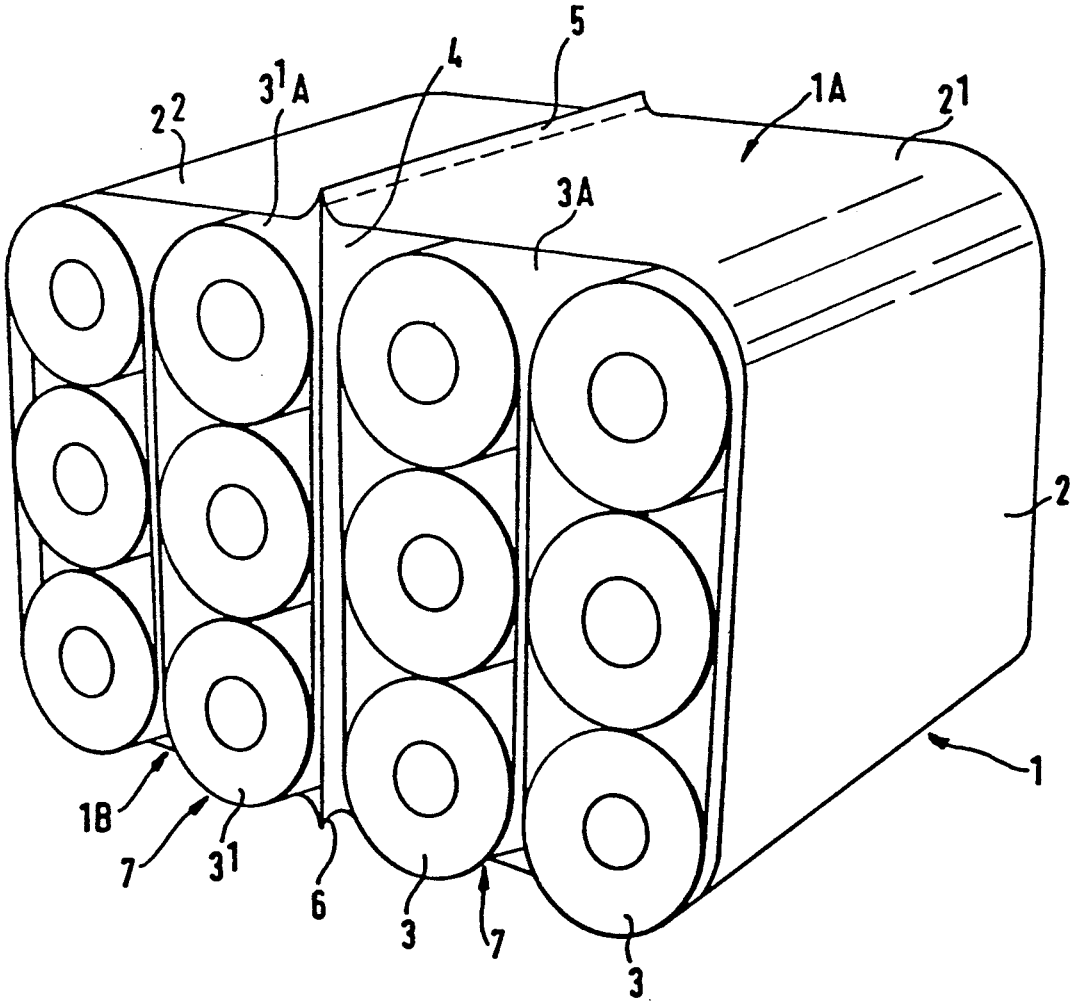
FIG. 17 illustrates a pack with a sleeve which extends along the circular peripheral surface of the pack unit.

The invention is clearly illustrated in FIG. 17, from which it will be seen that a pack 1, which lends itself to automated manufacture in a simple and efficient manner, and which includes a banderole-like pack sleeve 2 which is so arranged as to enclose in the manner of a loop a number of pack units 3, 3$^1$, such as rolls of soft tissue paper or packs of nappies, etc., is so arranged as to be held by means of a holding device 4. Said holding device 4, which, like the sleeve 2, is preferably in the form of a film, appropriately of a plastics material, is so arranged as to run essentially straight between pack units 3, 3$^1$ situated in pairs adjacent to one another and is attached to said sleeve 2 via joints 5, 6 which bare situated to either side 1A and 1B of said joints 5, 6 of the forms pack 1 and can have the form of a welded joint, a glued joint, a stitched joint or some other appropriate joint, which at the same tie holds together the three pieces of packaging material 2$^1$, 4, <2 which extend each from its own direction before meeting at a common point and hold the pack units 3, 3$^1$ securely in a desired position, in so doing making it much more difficult for the units 3, 3$^1$ to change position in relation to one another, that is to say for the pack 1 to change shape from its normally exhibited rectangular form to a circular form, for example, which form renders handling of the pack much more difficult.

The pack 1 illustrated in FIG. 17 consists of holding devices 4 and a sleeve 2 which extend along the preferably circular peripheral surface 3A, 3$^1$A of the pack units in question. A pack manufacturing method for the manufacture of a similar pack 1 is illustrated in diagrammatic form in FIGS. 1–6A, as well as an arrangement which lends itself to application to said manufacture.

Figure 18:
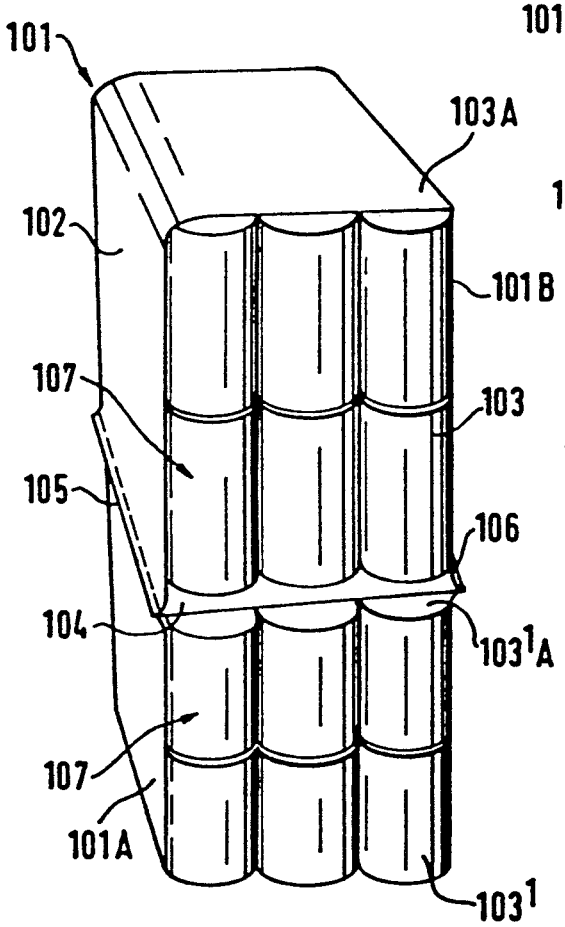
FIGS. 18 and 18A illustrate a pack with a sleeve which extends along the plane surface of the pack units.

The pack 101 illustrated in FIG. 18 consists of an appropriate number of holding devices 104 and a sleeve 102, which extend along the plane surface 103A, 103$^1$A of the pack units 103, 103$^1$, that is to say the end surfaces in the case of rolls. A method which is suitable for the manufacture of a similar pack 101 is illustrated in diagrammatic form in FIGS. 7–16A, as is an arrangement which lends itself to application to said manufacture.

Said pack 1 or 101 preferably consists of a number of items packed in groups, in conjunction with which said holding devices 4 and 104 extend along items packed in groups 7 and 107 which are situated to either side of said devices 4; 104.

The holding device 4 and 104 and the sleeve 2 and 102 are preferably so arranged as to subject that pack units 3, 3$^1$ and 103, 103$^1$ to tightening forces, in so doing increasing the ability of the packs to hold together and reducing the risk of units becoming displaced and falling from the pack 1; 101.

A method for production of a pack 1 or 101 of the kind indicated above may be executed as follows: three pieces of packaging material 8, 9, 10 and 108, 109, 110, each of which preferably runs from its own storage roll 11-13 and 111-113, are so arranged as to accept pack units 3, 3[1] and 103, 103[1] to either side of a centrally situated piece of packaging material 10 and 110, which later serves as a holding device 4 and 104, and as to be finally attached to one another at a certain distance from one another on opposing sides 1A, 1B and 101A, 101B of the formed pack 1 and 101, so that the two outermost pieces of packaging material 8, 9 and 108, 109 enclose all the pack units 3, 3[1] and 103, 103[1] and said centrally situated piece(s) of packaging material 4 and 104 in the manner of a banderole 2 and 102.

The starting point appropriately consists of three webs of packaging material 8-10 and 108-110 running from a first common joint 5 and 105, two of which webs 8, 9 and 108, 109 can run in a direction 14, 15 and 114, 15 towards one another and essentially perpendicularly in relation to said centrally situated piece of packaging material 10 and 110 running in the direction 16 and 116 towards said first joint 5 and 105.

Jointing of said three webs 8-10 and 108-110 at said first joint 5 and 105 can appropriately be achieved in conjunction with making the final attachment of the webs at a second joint 6 and 106 and cutting the webs.

An arrangement 17 and 117, which is situated for use in conjunction with the manufacture of a pack 1 and 101 in accordance with the present invention may consist of a feed device, for example in the form of feed roller 11-13 and 111-113 for the pieces of packaging material 8-10 and 108-110, which rollers are situated to either side of a forming station 118, which forming station is so arranged as to accept pack units 3, 3[1] and 103, 103[1].Said feed devices 11-13 and 111-113 are so arranged, in conjunction with the movement of a group 19 and 119 of formed pack units 3, 3[1] and 103, 103[1], as to feed three pieces of material 8-10 and 108-110 simultaneously towards one another and in the direction of adjoining device 20 and 120, so that one of the pieces of material 10 and 110 is surrounded by pack units 3, 3[1] and 103, 103[1]. A fixing tool 21 and 121 is perferably also present, which fixing tool is so arranged as to be capable of gripping along the pack units 3, 3[1] and 103, 103[1] and of fixing the formed and preferably compressed group 19 and 119 of pack units 3, 3[1] and 103, 103[1] for the period during which the pack 1 and 101 is being produced, so that, on being released, it will endeavour to adopt its original form, in so doing subjecting the pack to tension, thereby further ensuring the good handlability of the pack in conjunction with the automated palletization of same, for example, and enabling a so-called sales stack to be built in the shop.

Finally, for the purpose of achieving the efficient jointing of the pieces of the film 8-10 and 108-110, which film consists preferably of a plastics material, and of cutting them at the desired point, the arrangement 17, 117 can include welding devices 20A, 20B and 120A, 120B or other suitable connecting devices situated between the aforementioned forming station 18 and 118 and the jointing device 20 and 120, in addition to which a cutting device for cutting off the pieces of material is situated in the vicinity of said connecting devices 20A, 20B and 120A, 120B.

With reference to FIGS. 1-16 in the drawings, it is possible to make additional observations relating to the invention which are illustrated in conjunction with the packing of rolls of soft tissue paper 3, 3[1] and 103, 103[1] in such a way as to form packs 1 and 101 of essentially parallelepipedic form so as to permit, amongst other things, the economical and efficient handling of same after the production channel.

Figure 8:
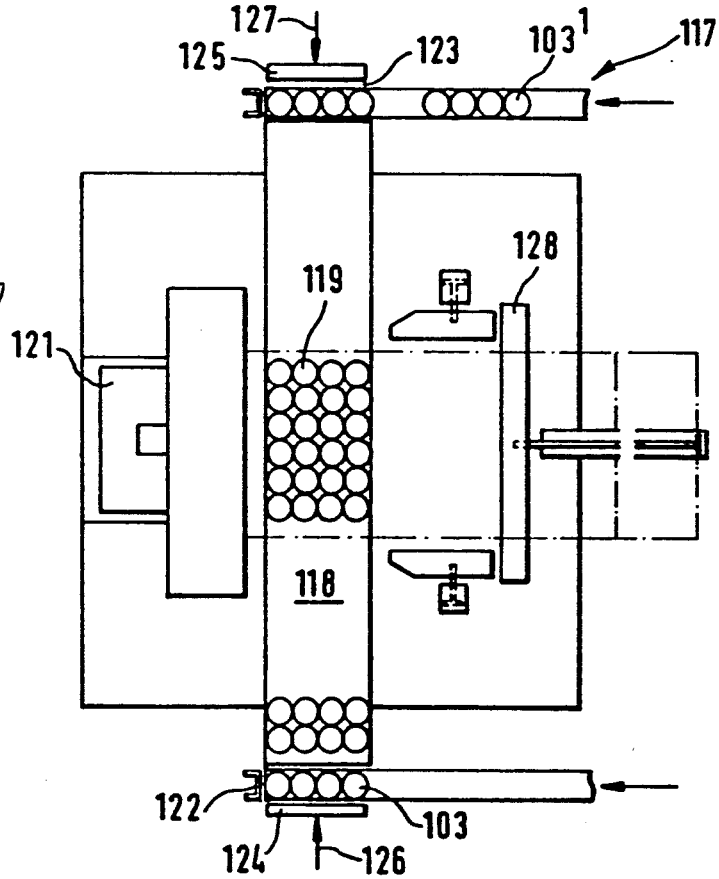
Figure 10:
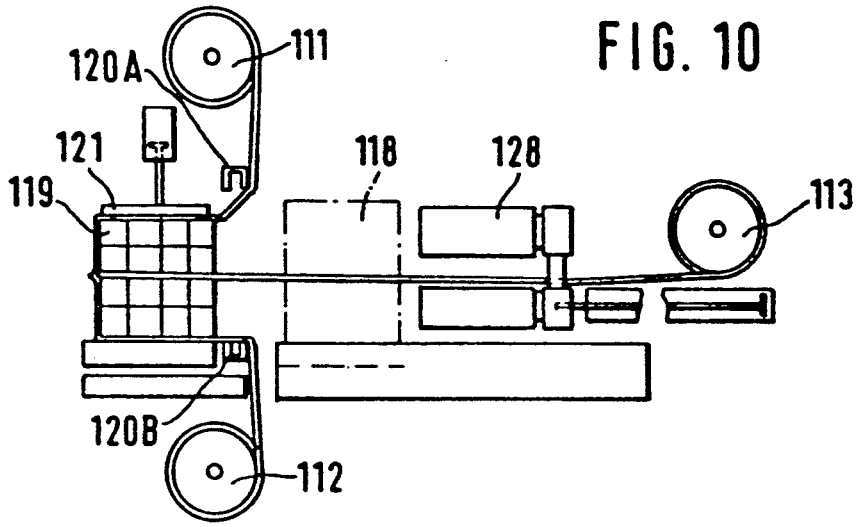

Rolls of paper, etc., 3, 3[1] and 103, 103[1], which arrive in a holding magazine 22, 23 nd 122, 123 situated to either side of the forming station 18 and 118, are pushed by means of pushing devices 24, 25 and 124, 125 in the direction 26, 27 and 126, 127 of an aforementioned forming station 18 and 118 in order to form a group 19 and 119 of rolls of paper, etc. The group 19, 119 formed by means of the tool 28, 128 in the forming station 18, 118 is aligned and is compressed in order to be transferred by the controlled resistance of the jointed film 8, 9 and 108, 109 situated ahead of it from the forming station 18; 118 to the jointing station 20; 120. The group 19; 119 is gripped, for example, by means of a plate-like fixing tool 21; 121, which group in its compressed and fixed state is packed by being enclosed by the films 8, 9; 108, 109, with the film 10; 110 extending through the group 19; 119 and retaining the inherent expansion force of the rolls, etc. In said position the tool 28; 128 will have returned to its starting position, as shown in FIGS. 2 and 8.

Figure 4:
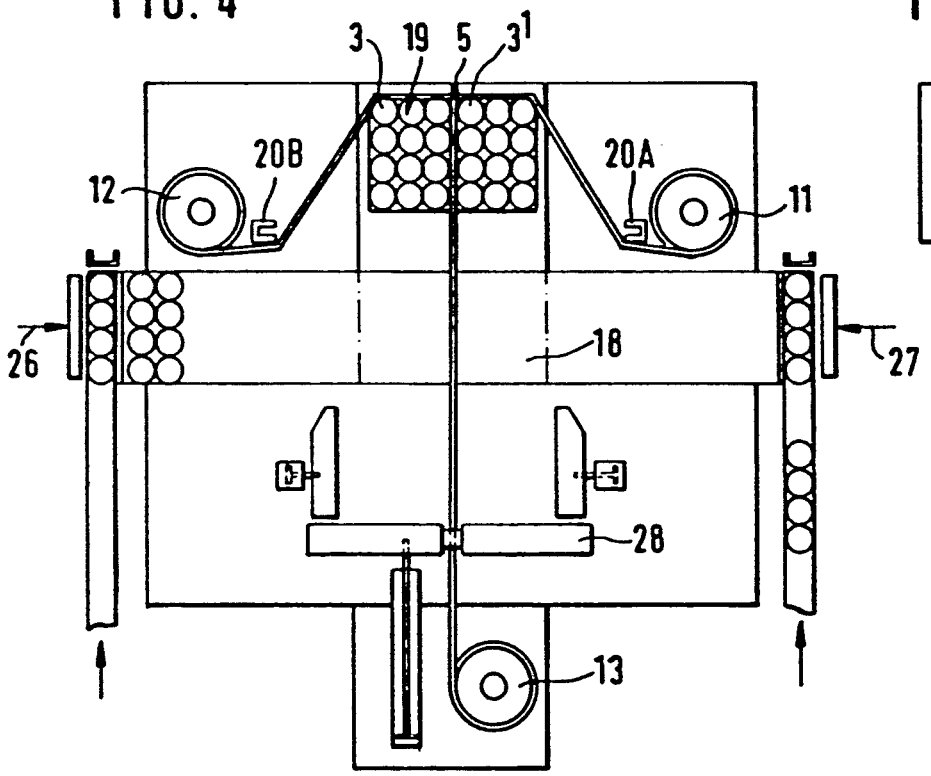
Figure 4A:
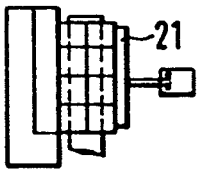
Figure 5:
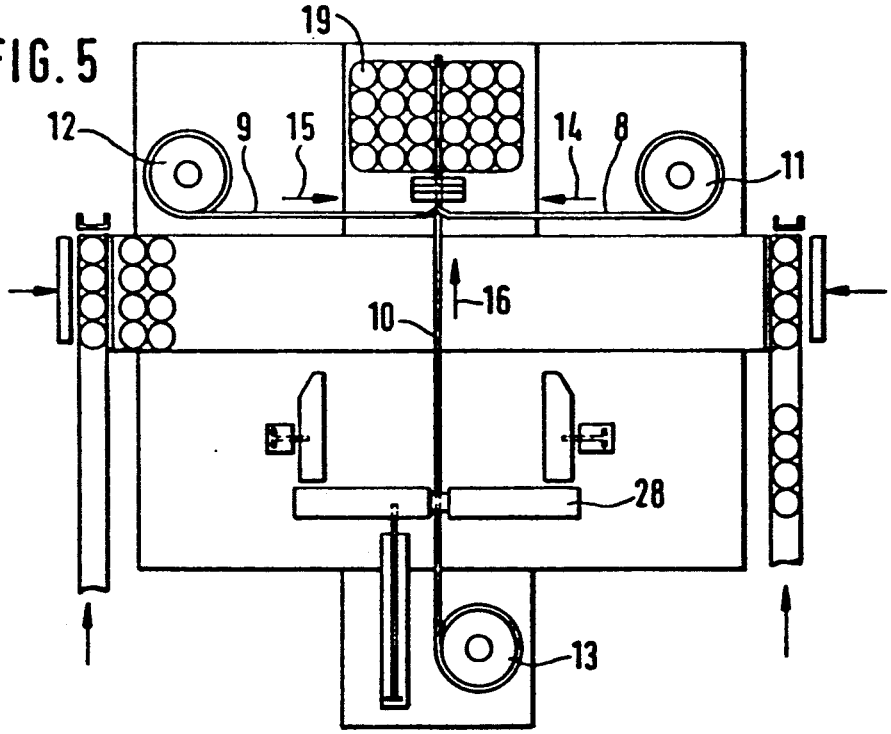
Figure 11:
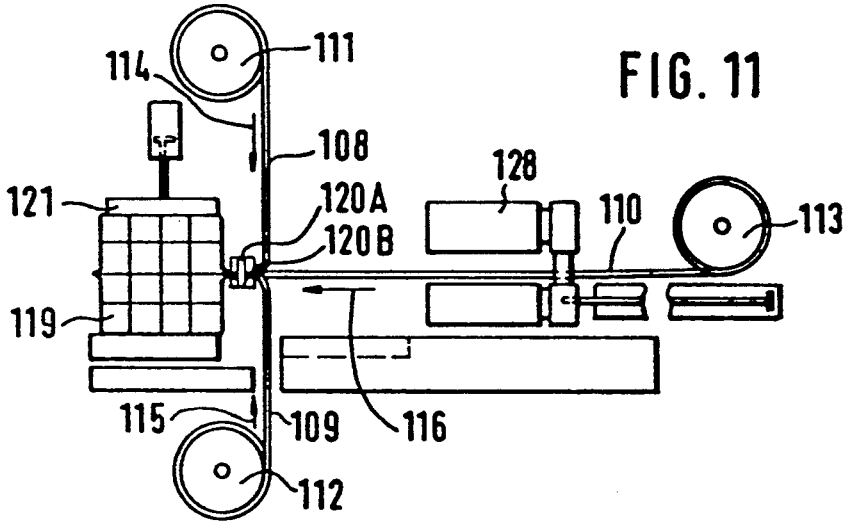

FIGS. 5 and 11 illustrate the manner in which the pieces of film 8-10; 108-110 for the group 19; 119 have been sealed by means of the welding jaws 20A, 20B; 120A, 102B by first producing a welded joint 5; 105 behind a group 19; 119 between, for example, the forming station 18; 118 and the jointing station 20; 120, so that a final joint 76 and 106 for a pack is produced at the same time as a first joint 5 and 105 for a following pack. The pieces of film 8-10 and 108-110 are cut between said joints 6, 5 and 106, 105 by means of cutting devices, which may be in the form of cutters built into a welding jaw 20A, 20B; 120A, 120B between sealing plates.

Figure 6:
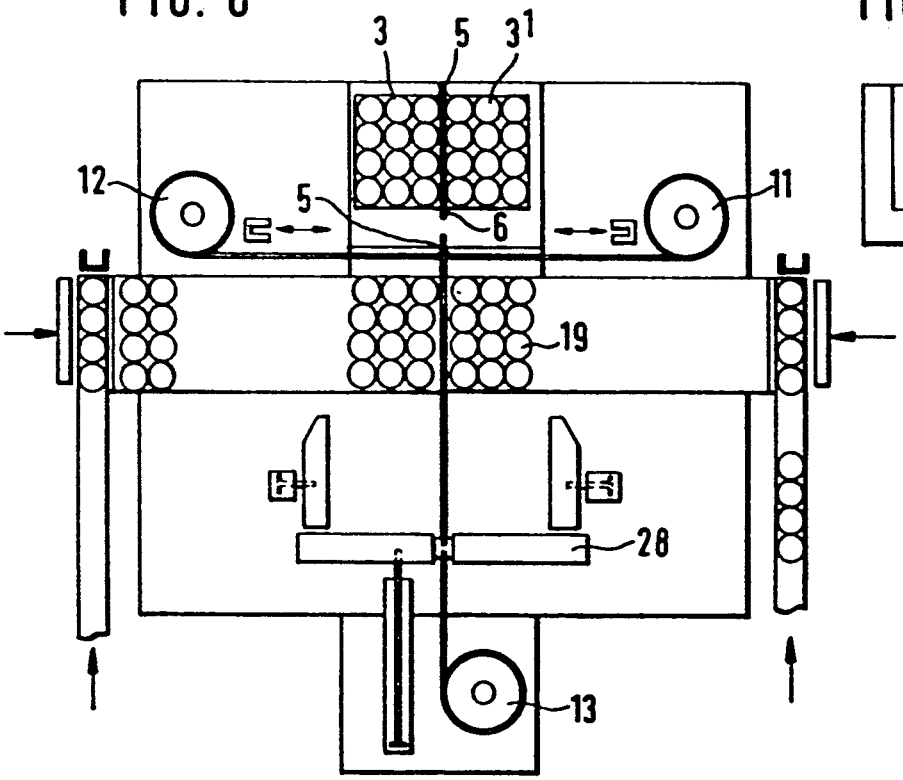
Figure 6A:
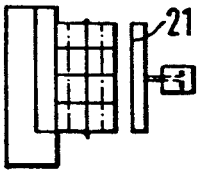
Figure 12:
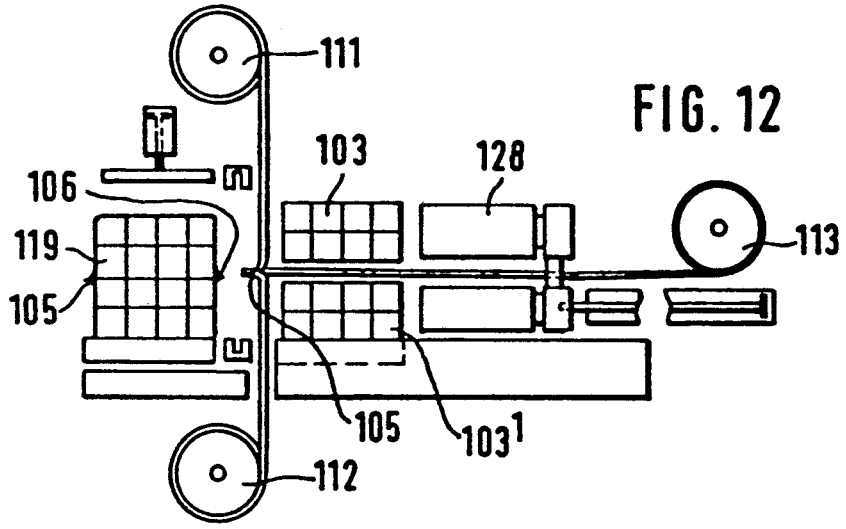

FIGS. 6 and 12 show the finished pack 1; 101 with the enclosing strips of film 8-10; 108-110. The fixing tool 21; 121 in said position will have released its grip on the pack, allowing the inherent reexpansion capacity of the rolls to take effect through being released, so that it causes further tensioning of the rolls against the enclosing strips of film 8-10; 108-110. The unit in accordance with FIG. 12 can also be supplemented by lateral sealing as shown in FIGS. 13-16A.

Figure 18A:
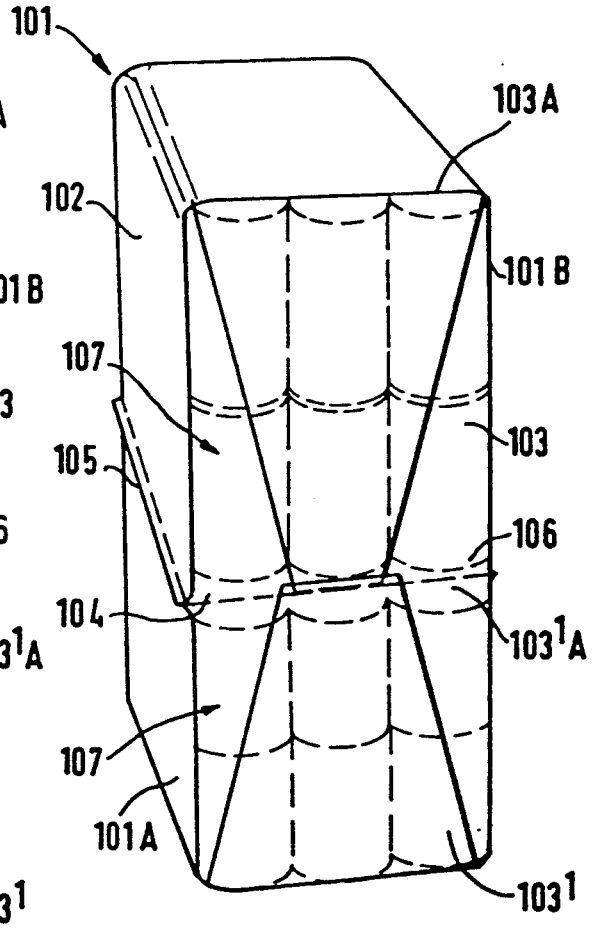

FIGS. 13-14 illustrate the tubular sleeves 130 which can be formed by the width of the strip of film 108, 109 from roll 111 and 112. The width of the film 110 from roll 113 determines the degree of reinforcement selected from the particular configuration. This can range from a narrow strip of film in the middle to a strip of film over the full width. The use of film which is wider than the width of the unit permits the side sealing also to include the film 110 for the roll 113 (see FIG. 18A). The fixing tool 121 must be in its working position during this operation, too, so as not to lose control of the unit.

FIG. 15 shows how the sealing jaws 131-134 have closed in pairs of produce the sealing position.

FIG. 16 shows how the fixing tool 121 and the sealing jaws 131-134 have resumed their respective starting positions, and how the unit is now completely enclosed and sealed.

Figure 7:
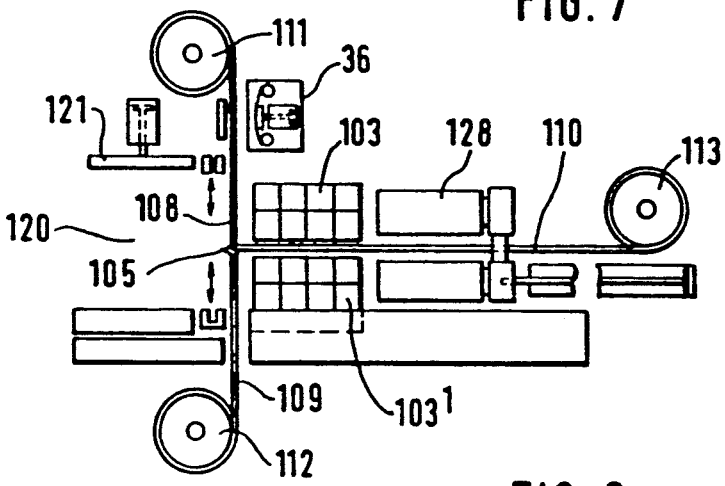
Figure 9:
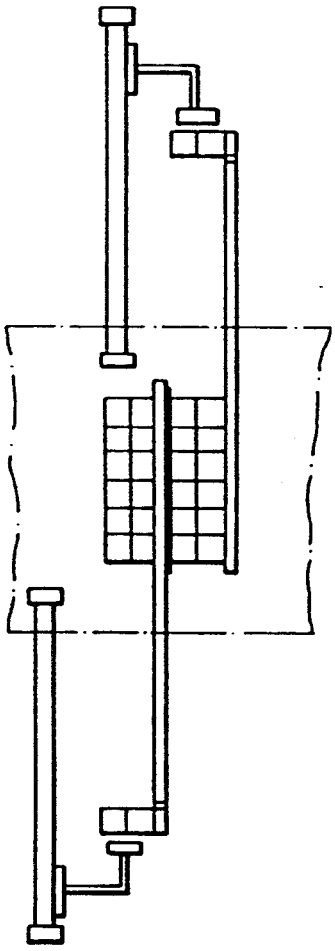

FIG. 7 also shows an arrangement 36 for the application of labels or for the marking of the film in some other way when it is held extended under control and n a fixed position.

The invention is not restricted to the illustrative embodiments of the invention described above an shown in the drawings, but can be modified within the scope of the patent claims without departing from the idea of invention.

I claim:

1. A method for the production of a retail pack containing a number of consumer pack units, said pack units being rolls of soft paper or packs of nappies, which are enclosed by a pack sleeve having a width which may range from a narrow strip up to but not exceeding the full width of the pack units, comprising the steps of:

extending three webs of packaging material to a first common joint, the first two of said webs extending to said first common joint from directions substantially opposite one another, connecting said first two webs to form a pack sleeve, extending the third of said webs to said first common joint from a direction substantially perpendicular to the first two of said webs, arranging the pack units to either side of said third web, physically separating said pack units on either side of said third web, mechanically compressing the previously uncompressed pack units to facilitate encompassment by said pack sleeve, and attaching said third web to said pack sleeve so as to subject the pack units to compressive forces, thereby increasing the ability of the pack units to hold together, reducing the likelihood of pack units becoming displaced, and preventing the pack units from changing form.

* * * * *